US005299991A

United States Patent [19]

Sato

[11] Patent Number: 5,299,991

[45] Date of Patent: Apr. 5, 1994

[54] FINGER TRAINING DEVICE

[76] Inventor: Atuhiko Sato, 5-10-20, Matsubara, Soka-Shi, Saitama-Ken, Japan

[21] Appl. No.: 997,595

[22] Filed: Dec. 28, 1992

Related U.S. Application Data

[63] Continuation-in-part of Ser. No. 638,071, Dec. 14, 1990, abandoned.

[51] Int. Cl.[5] ..... A63B 21/30

[52] U.S. Cl. ..... 382/44; 482/45; 482/44; 601/122

[58] Field of Search ..... 482/47, 49, 44, 45, 482/148, 114, 906, 908; 128/24.4, 24.3, 57, 26

[56] References Cited

U.S. PATENT DOCUMENTS

| | | | |
|---|---|---|---|
| 381,130 | 9/1932 | Auberger | 128/24.3 |
| 637,321 | 11/1899 | Casper | 128/24.4 |
| 1,710,051 | 4/1929 | Giacopazzi | 128/24.3 |
| 1,969,042 | 8/1934 | Senn | 428/24.3 |
| 3,625,202 | 12/1971 | Oyoshirhara | 128/24.3 |
| 3,672,093 | 6/1972 | Meek Sr. | 482/44 |
| 3,779,548 | 12/1973 | Sato | 482/44 |
| 4,577,858 | 3/1986 | Higami | 482/44 |
| 5,078,387 | 1/1992 | Faust et al. | 482/44 |
| 5,090,402 | 2/1992 | Bazin et al. | 128/24.4 |

FOREIGN PATENT DOCUMENTS

| | | | |
|---|---|---|---|
| 3243621 | 5/1984 | Fed. Rep. of Germany | 128/24.3 |
| 0001918 | 1/1957 | Japan | 482/44 |
| 120618 | 8/1975 | Japan | 482/44 |
| 52-24736 | 2/1977 | Japan | 482/44 |
| 363440 | 7/1962 | Switzerland | 128/24.4 |
| 347842 | 5/1931 | United Kingdom | 128/24.3 |

*Primary Examiner*—Stephen R. Crow
*Assistant Examiner*—Jerome Donnelly
*Attorney, Agent, or Firm*—Antonio R. Durando; Harry M. Weiss

[57] ABSTRACT

A finger training device that includes a grip portion that is rotatable with respect to a roller-supporting forked portion, wherein the forked portion can be bent with respect to the longitudinal direction of the grip portion and wherein a slidable finger frame is incorporated in the grip portion in an extendable and retractable manner. As a result of this construction, the grip portion is movable at various angles within a predetermined range relative to the rollers. Because of the presence of the finger frame, the device will not slip off the hand of a user when the gripping fingers are moved or the relative position of the palm of the hand with respect to the moving fingers is changed. The finger frame prevents the device from separating from the hand even if the grip portion comes off the palm of the hand.

16 Claims, 4 Drawing Sheets

FINGER TRAINING DEVICE

CROSS-REFERENCE TO RELATED APPLICATIONS

This application is a continuation-in-part continuing application of U.S. Ser. No. 07/638,071, filed on Dec. 14, 1990, now abandoned.

BACKGROUND OF THE INVENTION

1. Field of the Invention

The present invention relates to a portable finger training device.

2. Description of the Related Art

The applicant has described a finger training device in Japanese Patent Publication No. 38456/1977 and in U.S. Pat. No. 3,779,548, which is a translation thereof. This finger training device comprises a grip portion that can be gripped by one hand; a forked portion with two spaced arms that extend from the grip portion in a lateral direction; a pair of juxtaposed rollers rotatably supported by these arms and disposed substantially in parallel with the grip portion; and meshing gears fixed to these rollers whereby rotation of one of the rollers in one direction causes synchronous rotation of the other roller in the opposite direction. The device is used for training fingers by gripping the grip portion with at least two fingers and applying at least one of the other fingers to the rollers, so as to cause the rollers to rotate in opposite directions.

It has been known that intentional movement of fingers stimulates the brain and enhances the faculty of memory, such as by repetitively writing the spelling of a word. Further, from the viewpoint of cerebral physiology, it is understood that such movement of fingers may afford rehabilitative effects to physically handicapped or advanced-age persons and may be effective for training the fingers of a person lacking sufficient grasping power. The above-described device is therefore useful toward these ends.

It is also well known that when a large number of pyramid-shaped projections is provided on the periphery of the rollers of the finger training device and applied to points physiologically susceptible to stimulation, such application enhances blood circulation in the body and is effective in maintaining or improving health. For example, stimulation of physiologically active spots on fingers and toes will enhance the circulation of blood through the brain and internal organs, thus enhancing their functions, and is very effective in preventing aging.

However, the configuration of the above-described finger trainer and spot-stimulator does not allow the training of fingers while changing the angle of the grip portion and wrist with respect to the fingers. In addition, I found that the device may accidentally slip off a user's hand if the grip portion is gripped with a weak force. The present invention is directed at correcting these shortcomings.

BRIEF SUMMARY OF THE INVENTION

It is therefore the object of the present invention to improve the earlier finger training device by providing an apparatus that enables spot stimulation and that can be held in a stable manner, thereby being more effective in exercising for writing, finger rehabilitation, increase of gripping power, and memory enhancement of physically handicapped and advanced-age persons.

To achieve this objective, the present invention, which is an improvement of the above-mentioned finger training device, discloses a structural configuration in which the grip portion can rotate with respect to the roller-supporting forked portion, the forked portion can be bent with respect to the longitudinal direction of the grip portion, and a slidable finger frame is incorporated in the grip portion in an extendable and retractable manner. As a result of this construction, the grip portion is movable at various angles within a predetermined range relative to the rollers. Because of the presence of the finger frame, the device will not slip off the hand of a user when the gripping fingers are moved or the relative position of the palm of the hand with respect to the moving fingers is changed. The finger frame prevents the device from separating from the hand even if the grip portion comes off the palm of the hand.

Furthermore, because of the pyramid-shaped projections and the resulting depressions formed on the periphery of the rollers, the device of this invention is effective in stimulating physiologically active spots on the finger tips and on other portions of the body that can be reached by the hand.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose only some of the various ways in which the invention may be practiced.

DETAILED DESCRIPTION OF THE PREFERRED EMBODIMENTS

Figure 1:
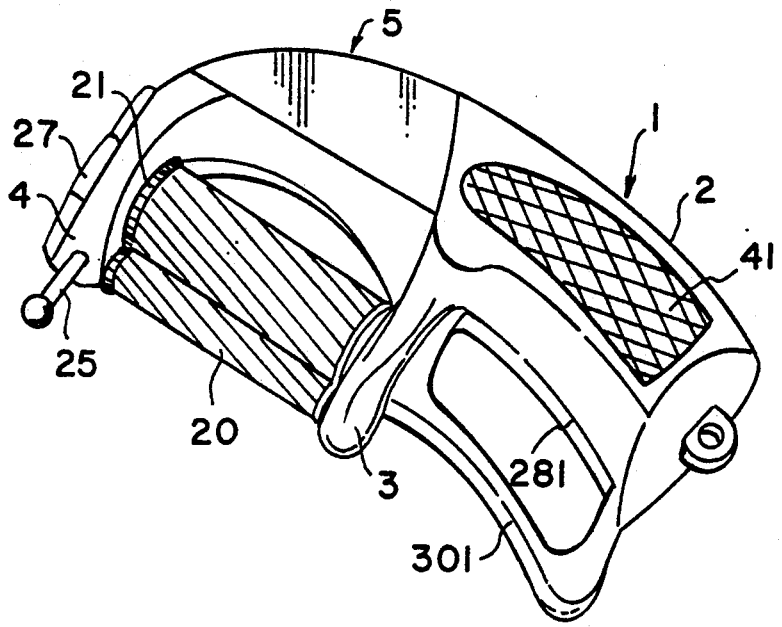
FIG. 1 and 2 are perspective views of the finger training device of this invention showing two different positions of the grip portion with respect to the training rollers.
Figure 6:
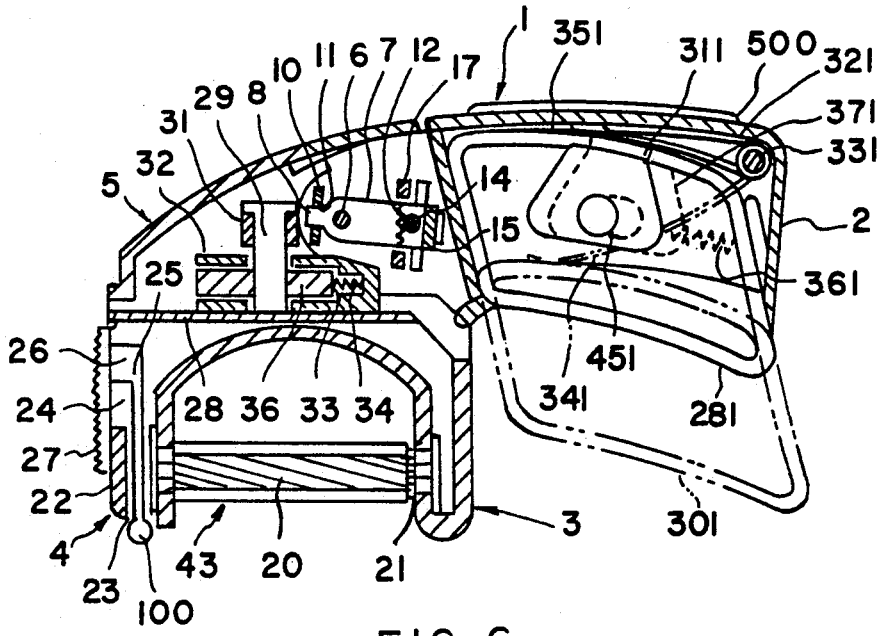
FIG. 6 is a plan cross-sectional view of the finger training device of the invention.

Referring to the drawings, wherein like parts are designated throughout with like numerals and symbols, FIG. 1 illustrates in perspective view the preferred embodiment of the finger training device of this invention. As illustrated in detail in FIGS. 1 through 11, this finger training device consists of a grip portion 1, sized so that it can be gripped by one hand, and a roller-supporting frame 5 comprising two spaced arms 3 and 4 for supporting two parallel rollers 20. As seen in FIG. 6, a roller-mounting frame 43 is located at the forward end of the support frame 5. The grip portion 1 and the roller-supporting frame 5 are hingedly connected together by a support pin 6, in such a manner that they can be rotated within a predetermined range of angles with respect to one another. As seen particularly in FIGS. 6, 9 and 10, a positioning frame 7, fixedly disposed within the roller-support frame 5, is pivotally supported with respect to the grip portion 1 by means of the support pin 6. One end 8 of the positioning frame 7 is insetted in a slot 11 cut in a stopper plate 10 provided in the roller-supporting frame 5, thereby providing the required fixed connection between the positioning frame 7 and the roller-support frame 5. At the opposite end 8' of the positioning frame 7, which is preferably made of metal, a plurality of notches 12 is formed along an arcuate configuration. The notches 12 are engaged by a spring-loaded tubular body 14, into which a rod-shaped spring 13 is inserted longitudinally to provide resilient resistance to the motion of the positioning frame 7 (see FIG. 10).

Figure 9:
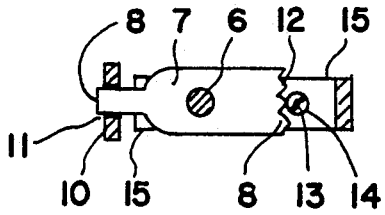
FIG. 9 is a plan cross-sectional view of another portion of the finger training device showing the mechanism for maintaining the angle of rotation of the roller supporting frame.
Figure 10:
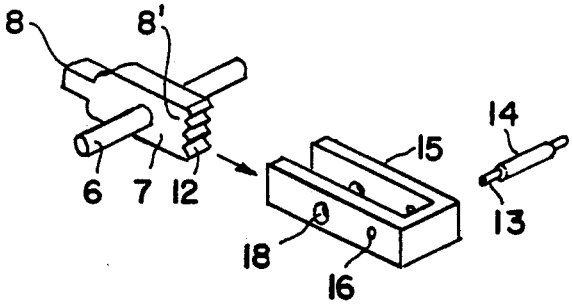
FIG. 10 is an exploded perspective view of the mechanism shown in FIG. 9.
Figure 11:
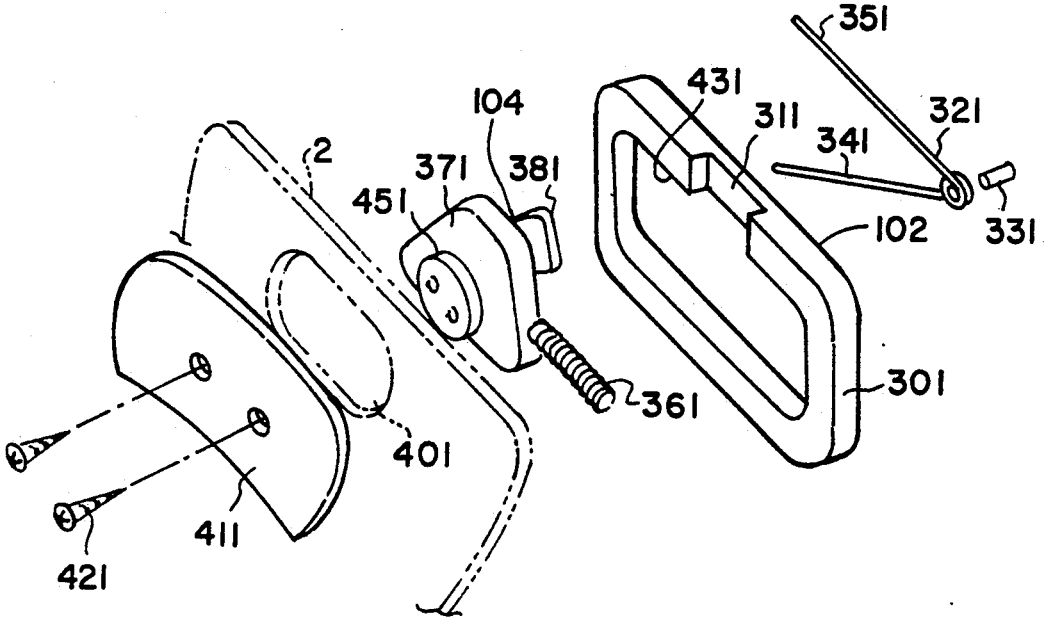
FIG. 11 is an exploded view of the mechanism comprising the finger frame shown in FIG. 6.

As shown in FIGS. 6, 9 and 10, the rod-shaped spring 13 is inserted into apposite holes 16 on both sides of a U-shaped frame 15 and is held thereby. The U-shaped frame 15 is fixedly disposed within the grip portion 1 by means of a holding frame 17 attached thereto which provides a rigid slotted support for the frame 15. Finally, two through-holes 18 slotted in both sides of the U-shaped frame 15 provide a pivotal anchor for the support pin 6, which is disposed to extend outwardly therefrom.

Consequently, the grip portion 1 and the roller-supporting frame 5 can be rotated about the support pin 6 through a predetermined set of angles determined by the position of the notches 12 along the curved end 8'. By virtue of the pressure exercised by the rod-shaped spring 13 on the tubular body 14, upon which one of the notches 12 is engaged, said angular position can be held in a stable manner.

Figure 12:
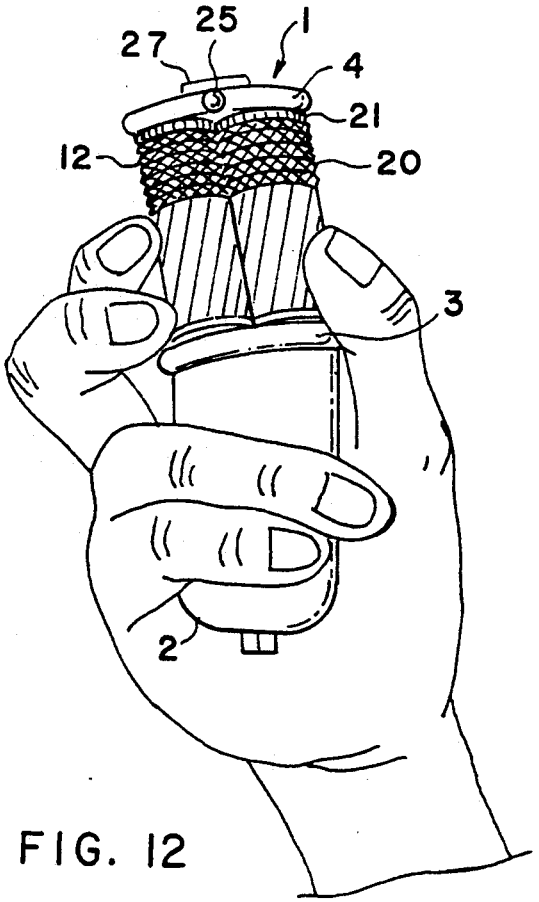
FIG. 12 shows an embodiment in which part of the rollers is covered with pyramid-shaped projections.

A pair of rollers 20, having projections and depressions forming peripheral ridges substantially in axial direction (provided for friction), is rotatably mounted between the arms 3 and 4 of the roller-supporting frame 5. As illustrated in FIG. 6, a gear 21 is secured to one end of each roller 20. The two gears 21 mesh with each other so that the two rollers 20 will rotate simultaneously in the opposite direction when one of them is rotated by finger tips. As shown in FIG. 12, part (or all) of the periphery of each roller 20 may contain pyramid-shaped projections 21.

Incorporated within the outer arm 4 is a cavity 24 that includes a channel 23 that extends in the longitudinal direction of the arm 4. An elongated pointer 25 is slidably mounted into the channel 23. The pointer 25 comprises a neck 26, that is slidably arranged in the cavity 24, and a finger plate 27, which is slidably mounted over the upper end 22 of the arm 4, the neck 26 and plate 27 being preferably formed as integral parts of the pointer 25. Thus, the pointer 25 can be moved back and forth to cause its forward end 100 to be in a retracted or extracted position, respectively.

Figure 7:
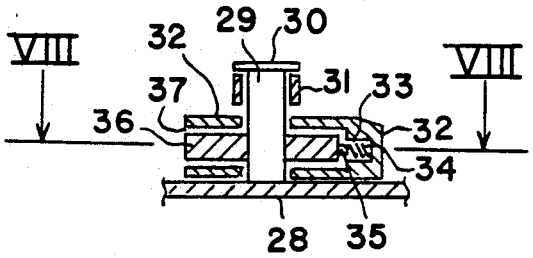
FIG. 7 is a plan cross-sectional view of a portion of the finger training device showing the rotary mechanism of the roller mounting frame.
Figure 8:
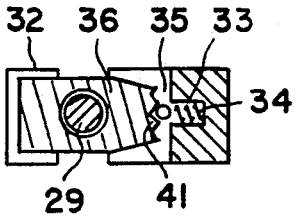
FIG. 8 is a transverse cross-sectional view of the portion shown in FIG. 7, as seen from line VIII—VIII in that figure.

The roller-mounting frame 43, which comprises the rollers and pointer described above, is itself rotatably attached to the roller-supporting frame 5. As shown in FIGS. 6, 7 and 8, a rotary shaft 29 projecting from the upper surface 28 of the roller-mounting frame 43 is inserted into a guide tube 31 provided within the roller-supporting frame 5 and is prevented from falling out of the guide tube 31 by means of a flange 30. A positioning plate 36 is fixedly connected to the rotary shaft 29.

A U-shaped fixing frame 32, seen laterally in FIGS. 6 and 7 and in plan view in FIG. 8, comprises two parallel plates attached to the interior of the roller-supporting frame 5. The positioning plate 36 provided on the rotary shaft 29 is inserted into the gap 37 between the upper and lower plates of the fixing frame 32. Further, a recess 33 is provided deep in the gap 37 of the fixing frame 32, wherein a spring 34 and a ball 35 are accommodated, so that the ball 35 is pressed against and engaged by one of a plurality of recesses 41 provided in the forward end of the positioning plate 36. When the roller-mounting frame 43 (and the rotary shaft 29) are rotated about the roller-support frame 5, the ball 35 is brought into pressing engagement with one of the depressions 41 formed on the forward end of the positioning plate 36 at different angular positions with respect to the rotary shaft, so that the roller-mounting frame 43 can be rotated to any of these positions.

Figure 3A:
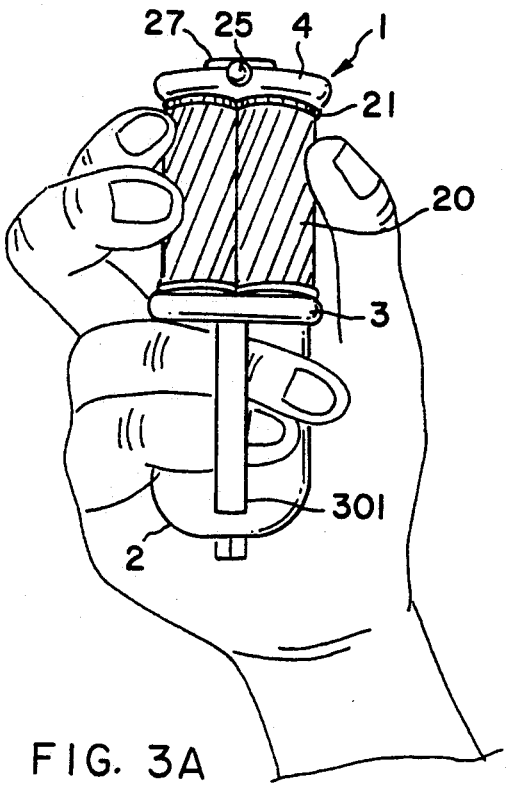
FIGS. 3A and 3B are perspective views illustrating the device of the invention in use with two different positions of the roller mounting frame with respect to the gripping portion.
Figure 3B:
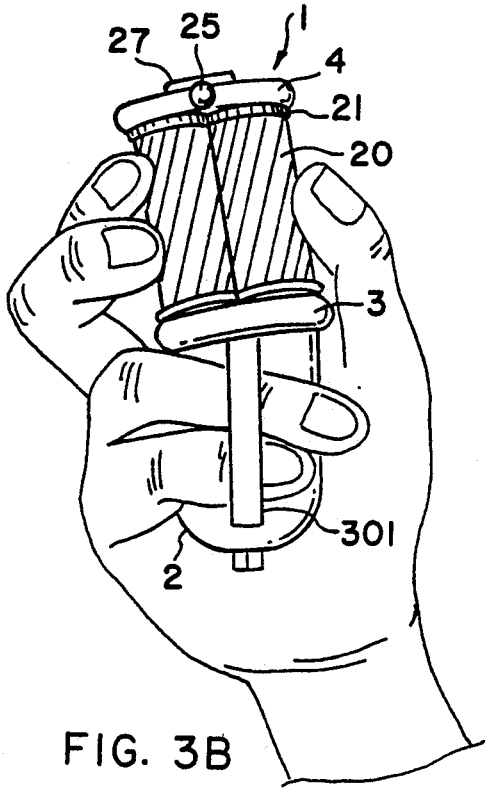
Figure 4:
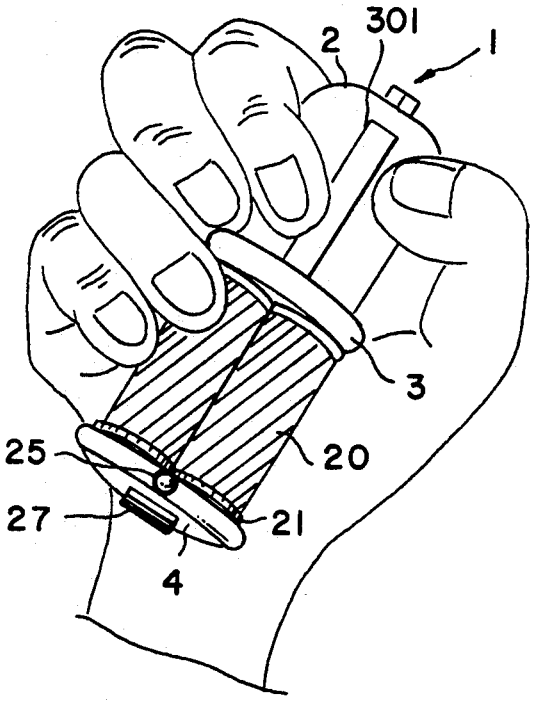
FIGS. 4 and 5 are perspective views illustrating the device of the invention in use in additional gripping configurations.
Figure 5:
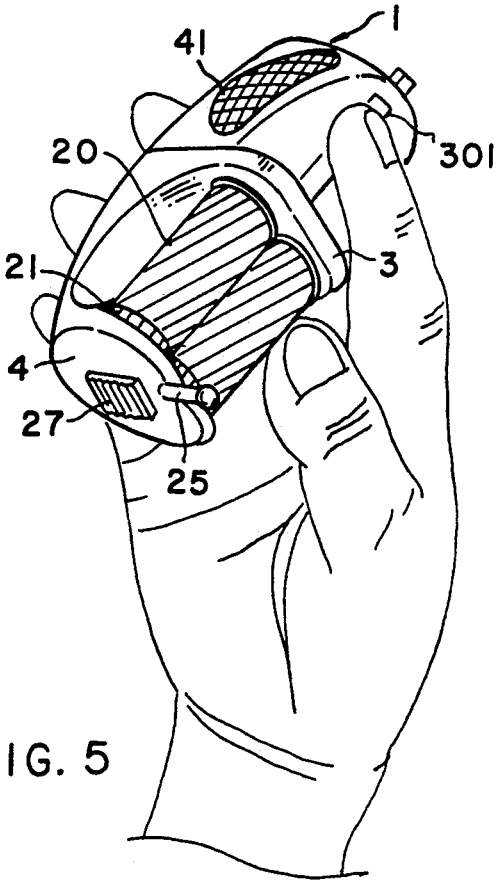

It is therefore possible to perform finger training at different angular positions of the roller-supporting frame 5 relative to the rollers 20, as shown in FIGS. 3A and 3B; this means that finger training can be performed with the wrist, which will normally be aligned with the grip portion 1 and the roller-supporting frame 5, positioned at different angles relative to the finger tips that rotate the rollers. Further, training for writing purposes can be performed by imagining to be writing by manipulating the finger training device, so that real conditions under which writing would normally occur can be simulated.

Thus, in addition to the angular motion of the roller-support frame with respect to the grip portion 1, the finger training device of the invention also provides rotational motion of the roller-mounting frame 43 in relation to the roller-support frame 5. Therefore, the device can be gripped by the grip portion 1 while the roller-supporting frame 5 is in a rotated position at a predetermined angle about the support axis 6. Similarly, the roller mounting frame 43 can be moved by rotating it about the rotary shaft 29. The result is that a user can train the fingers of a hand while simulating various conditions under which he would grip a writing utensil, such as a fountain pen or pencil, in different manners.

Thus, the finger training device of this invention can be effectively used to perform training of fingers by rotating the rollers with the tips of the fingers while holding the grip in the hand, thereby stimulating the brain to combat the loss of dexterity normally incident to aging. It is similarly helpful in rehabilitating or improving the manual dexterity of physically handicapped and advanced-age people. Specifically, the finger training device of the invention is particularly suited for writing exercises. Because of the configuration of its various parts, the roller-mounting frame can be rotated by a selected angle relative to the grip and to the roller-supporting frame, whereby the angle between the wrist and finger tips can be changed during training to conform to the way the user would grip a writing utensil according to his natural writing style. This position makes it easier for the user to imagine a point corresponding to the tip of a writing utensil, thus enabling him to utilize the finger training device as a writing tool.

Figure 2:
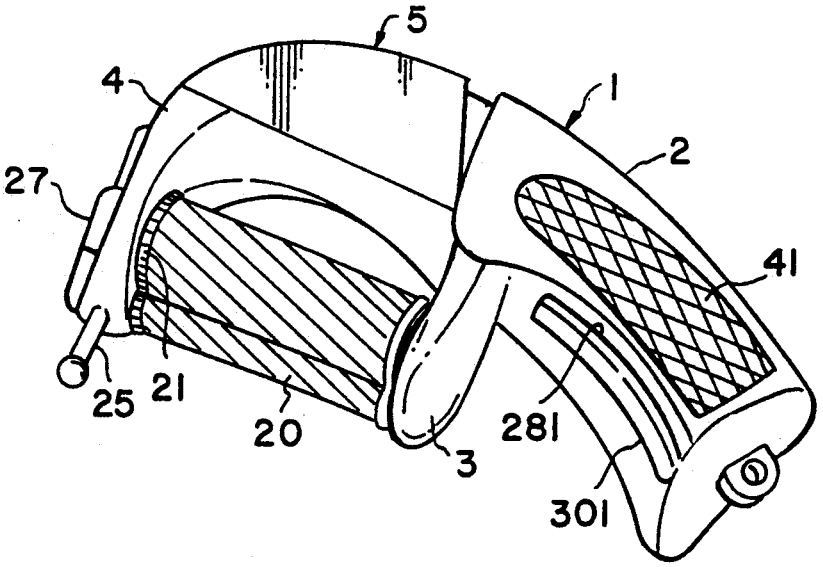

Referring now to FIGS. 1, 2 and 6, the arrangement of the components within the handle 2 of the grip 1 is hereinafter described. The handle 2, which corresponds to the bottom portion of the grip 1, is hollow and contains an opening 281 formed in the lower portion thereof. A finger frame 301, slidably slotted through this opening 281, can be moved in and out of the cavity in the handle 2. As shown in the exploded view of FIG. 11, the finger frame 301 is substantially in the form of a rectangle and has a recessed cut-out 311 on one side of the upper portion 102 thereof. A spring 321 is mounted on a pivot 331 attached to the upper corner in the cavity of the handle 2, as seen in FIG. 6. One end 341 of the spring is in contact with the upper surface of the upper portion 102 of the finger frame and the other end 351 is in contact with the inside surface of the upper portion of the handle 2, whereby the finger frame 301 is urged downward to project out of the opening 281. A slider 371, urged laterally with respect to the finger frame 301 by a spring 361 and movable essentially in the direction perpendicular to the direction in which the finger frame 301 is slidable, is mounted on a plane parallel to the finger frame within the cavity of the handle 2. The slider 371 comprises a stopper 381 projecting from one side thereof which, when placed in the recessed cut-out 311 in the finger frame 301, allows the finger frame to be slided and projected out of the opening 281. A slider-operating plate 411 is provided on the outside of the handle 2, connected to the slider 371 by means of screws 421 fitted to a projection 451 in the slider 371 through a guide hole 401 in the handle 2. The guide hole 401 is sized to permit the lateral movement of the projection 451 (and, therefore, also of the slider 371) but not their movement in any other direction.

Therefore, when the finger frame 301 has been retracted all the way into the handle 2 against the spring 321, the stopper 381 is urged by the spring 361 to a position on one side of the recessed cut-out 311 along the lower edge 431, as shown in broken line in FIG. 6; thus, the finger frame 301 is prevented by the slider 371 from sliding out of the handle and can be maintained in a retracted position. In order to release the finger frame, the slider-operating plate 411 is operated against the action of the spring 361 to bring the stopper 381 in alignment with the recessed cut-out 311, whereby it becomes possible for the spring 321 to urge the cut-out 311 over the stopper 381, thus causing the finger frame 301 to project out of the opening 281. If the finger frame 301 is again to be retracted into the handle 2 after it has been projected out to the opening 281, the frame 301 may be pressed upward by hand against the spring 321 without requiring the operation of the slider operating plate 411. As the finger frame 301 is thus pushed all the way up, the recessed cut-out 311 will release the inside edge 104 of the spring-loaded stopper 381 (which may be rounded for a smoother release) and the stopper will move laterally to catch the lower edge 431 of the finger frame to again lock it in a retracted position.

In operation, the finger training device of this invention is used by gripping the handle 2 and pivoting the roller-mounting frame 5 about the support pin 6 by a chosen angle to allow a user to reach the rollers 20, so that he can train his fingers while simulating various situations where he would use various utensils, such as a fountain pen or pencil, for writing excercises. As shown in FIGS. 3A and 3B, the rollers 20 can be flipped by the finger tips of the thumb, index and middle fingers, the fingers normally used while writing, with the ring and little fingers gripping the handle 2 through the extracted finger frame 301. Thus handled, the device will not fall off the hand of the user, even if held tentatively and without dexterity, because of the retaining function provided by the finger frame 301. An elastic pad 500 (FIG. 6) may be added to the outside surface of the handle 2 to improve the ease with which the device may be gripped.

As described above, the finger training device of the invention may also be used by applying the pyramid-shaped projections of the rollers against various parts of the body for stimulating physiologically active spots thereon, or may be used to enhance blood circulation by massaging various parts of the body. Further, the device can be used by rotating the rollers or sliding the finger plate on the roller-mounting frame with finger tips to perform exercises that stimulate the brain and slow the process of aging, thus providing a useful tool for the rehabilitation of physically handicapped persons and the maintenance of manual dexterity in advanced-age people. Since the roller-mounting frame of the finger training device is also rotatable through a range of angles relative to the grip and roller-supporting frame, the device can be deformed so that it can be gripped in the most suitable manner to perform any of the mentioned tasks.

Because of the finger frame within the grip of the invention, the device offers the advantage of ensuring a firm and steady grip on the handle by the action of the little and ring fingers positioned thereon, which prevent the unintentional movement of the handle during use and permit the smooth rotation of the rollers. Fine or delicate movements of finger tips thus become possible. The device is therefore expected to be more efficient in training for writing skills, as compared to earlier devices.

While the embodiments shown in the figures feature the specific shapes therein described, the invention can obviously take other shapes with equivalent functionality and utility. In fact, any shape for any of the components that retains the functional characteristics described above provides an acceptable apparatus to practice the invention. Various changes in the details, steps and materials that have been described may be made by those skilled in the art within the principles and scope of the invention herein illustrated and defined in the appended claims. Therefore, while the present invention has been shown and described herein in what is believed to be the most practical and preferred embodiments, it is recognized that departures can be made therefrom within the scope of the invention, which is therefore not to be limited to the details disclosed herein but is to be accorded the full scope of the claims so as to embrace any and all equivalent apparatus and methods.

I claim:

1. A finger training device comprising:

(a) a grip that includes a longitudinal handle that can be gripped by one hand;

(b) a roller-supporting frame connected to said grip; and (c) a pair of lateral arms in said roller-supporting frame containing a pair of rollers juxtaposed therebetween and mounted in a position substantially parallel to said grip, each of said rollers having a gear at one end thereof, and said gears meshing with each other so that they can rotate in opposite directions;

wherein said roller-supporting frame includes hinge means rotatably coupling said roller supporting means and said grip so that the roller-supporting frame can be rotated to plurality of predetermined angular positions with respect to the grip.

2. The finger training device claimed in claim 1, further comprising a spring-loaded finger frame that can be extended out of and retracted into the handle of said grip.

3. The finger training device claimed in claim 1, wherein said rollers further comprise pyramid-shaped projections on at least part of the periphery of the rollers.

4. The finger training device claimed in claim 1, wherein an elastic pad is applied to the handle of said grip.

5. The finger training device claimed in claim 1, further comprising a finger plate slidably mounted on said pair of lateral arms in said roller-supporting frame.

6. A finger training device comprising:

(a) a grip that includes a handle that can be gripped by one hand;

(b) a roller-supporting frame connected to said grip and comprising a roller-mounting frame; and (c) a pair of lateral arms in said roller-mounting frame containing a pair of rollers juxtaposed therebetween and mounted in a position substantially parallel to said grip, each of said rollers having a gear at one end thereof, and said gears meshing with each other so that they can rotate in opposite directions;

wherein said roller-mounting frame is rotatably connected to the roller-supporting frame and can be rotated to at least two angular positions about an axis substantially normal to the roller-supporting frame.

7. The finger training device claimed in claim 6, further comprising a spring-loaded finger frame that can be extended out of and retracted into the handle of said grip.

8. The finger training device claimed in claim 6, wherein said rollers further comprise pyramid-shaped projections on at least part of the periphery of the rollers.

9. The finger training device claimed in claim 6, wherein an elastic pad is applied to the handle of said grip.

10. The finger training device claimed in claim 6, further comprising a finger plate slidably mounted on said pair of lateral arms in said roller-supporting frame.

11. A finger training device comprising:

(a) a grip that includes a handle that can be gripped by one hand;

(b) a roller-supporting frame connected to said grip and comprising a roller-mounting frame; and (c) a pair of lateral arms in said roller-mounting frame containing a pair of rollers juxtaposed therebetween and mounted in a position substantially parallel to said grip, each of said rollers having a gear at one end thereof, and said gears meshing with each other so that they can rotate in opposite directions;

wherein said roller-supporting frame includes hinge means rotatably coupling said roller supporting means and said grip so that the roller-supporting frame can be rotated to a plurality of predetermined angular positions with respect to the grip; and wherein said roller-mounting frame is rotatably connected to the roller-supporting frame and can be rotated to at least two angular positions about an axis substantially normal to the roller-supporting frame.

12. The finger training device claimed in claim 11, further comprising a spring-loaded finger frame that can be extended out of and retracted into the handle of said grip.

13. The finger training device claimed in claim 11, wherein said rollers further comprise pyramid-shaped projections on at least part of the periphery of the rollers.

14. The finger training device claimed in claim 11, wherein an elastic pad is applied to the handle of said grip.

15. The finger training device claimed in claim 11, further comprising a finger plate slidably mounted on said pair of lateral arms in said roller-supporting frame.

16. The finger training device claimed in claim 11, further comprising a spring-loaded finger frame that can be extended out of and retracted into the handle of said grip, and comprising a finger plate slidably mounted on said pair of lateral arms in said roller-supporting frame;

wherein said rollers further comprise pyramid-shaped projections on at least part of the periphery of the rollers, and wherein an elastic pad is applied to the handle of said grip.

* * * * *